US006183150B1

(12) United States Patent
Kao

(10) Patent No.: US 6,183,150 B1
(45) Date of Patent: Feb. 6, 2001

(54) COMPUTER KEY

(75) Inventor: George Kao, Taipei (TW)

(73) Assignee: Peripheral Technology Inc., Taipei (TW)

( * ) Notice: Under 35 U.S.C. 154(b), the term of this patent shall be extended for 0 days.

(21) Appl. No.: 09/487,219

(22) Filed: Jan. 19, 2000

(51) Int. Cl.[7] ..... B41J 5/16
(52) U.S. Cl. ..... 400/495; 400/491.2; 200/344
(58) Field of Search ..... 400/495, 491.2, 400/491, 490, 472, 495.1; 200/344, 5 A; 361/680

(56) References Cited

U.S. PATENT DOCUMENTS

| | | | | |
|---|---|---|---|---|
| 5,278,372 | * | 1/1994 | Takagi et al. | 200/344 |
| 5,488,210 | * | 1/1996 | Shigetaka | 200/344 |
| 5,829,589 | * | 11/1998 | Tsai | 200/344 |
| 5,842,798 | * | 12/1998 | Su | 400/491.2 |
| 5,986,227 | * | 11/1999 | Hon | 200/344 |
| 5,997,196 | * | 12/1999 | Hu | 400/495 |
| 6,020,565 | * | 2/2000 | Pan | 200/344 |
| 6,068,416 | * | 11/1999 | Kumamoto et al. | 400/491 |

* cited by examiner

*Primary Examiner*—John S. Hilten
*Assistant Examiner*—Anthony H. Nguyen
(74) *Attorney, Agent, or Firm*—Baker Botts L.L.P.

(57) ABSTRACT

A computer key includes first and second linking frames interconnecting pivotally a base plate and a push button. The first and second linking frames are connected pivotally at first and second linking arms thereof. Each of the second linking arms has a pin member extending outwardly and transversely therefrom, and a second transverse axle connected thereto. Each of the first linking arms has a first transverse axle connected thereto, and an elongated slot extending in a longitudinal direction thereof. Each of the first linking arms further has a protrusion projecting from an internal wall of the elongated slot to form left and right sections longitudinally of the elongated slot. The protrusions prevent the pin members from moving back to the left sections from the right sections when the pin members are inserted initially into the left sections and are forced to pass into the right sections through a restricted section between the left and right sections to enable the first and second transverse axles to be inserted and retained slidably in right and left guideways formed on the base plate, respectively.

4 Claims, 10 Drawing Sheets

COMPUTER KEY

BACKGROUND OF THE INVENTION

1. Field of the Invention

This invention relates to a computer key, more particularly to a computer key that has a pair of pivotally connected linking frames disposed between a base plate and a push button, wherein the linking frames are retained positively on the base plate.

2. Description of the Related Art

U.S. Pat. No. 5,580,194 discloses a computer key including a one-piece base plate which is punched to form left and right retaining guideways that are spaced apart from each other in a longitudinal direction of the base plate. The retaining guideways include left and right retaining portions which extend uprightly from the base plate, and left and right blocking portions which extend from distal ends of the retaining portions away from each other and substantially longitudinal to the base plate. The blocking portions have left and right widths defined in a direction transverse to the longitudinal direction by front and rear left and right rough edges. A frame assembly includes first and second linking frames which are pivotally connected at intermediate portions thereof. Each of the first and second linking frames includes a transverse axle oriented in a transverse direction of the base plate, and having a middle segment of a length shorter than the width of the respective blocking portion and insertable slidably under the respective blocking portion, and front and rear segments which extend beyond the front and rear rough edges of the respective blocking portion. The first linking frame has a pair of first linking arms respectively and radially extending from the front and rear segments thereof. The second linking frame has a pair of second linking arms respectively and radially extending from the front and rear segments thereof. Each of the second linking arms includes a pin member extending outwardly and transversely from the intermediate portion thereof. Each of the first linking arms has an elongated slot formed longitudinally in the intermediate portion thereof for inserting the pin member of the respective one of the second linking arms therein such that the pin member is movable along the elongated slot. The intermediate portion of each of the first linking arms has a guiding groove disposed in an inner surface thereof proximate to the second linking arm that is pivotally connected thereto. The guiding groove extends downwardly from an upper surface in a direction transverse to the first linking arms and is communicated with the respective one of the elongated slots so as to guide insertion and slipping of the pin member into the respective one of the elongated slots from above.

After the first and second linking arms have been pivotally connected to each other, the transverse axle of the first linking frame is initially inserted under the right blocking portion. The transverse axle of the second linking frame is pulled by shifting the pin members in the elongated slots so as to permit the second transverse axle to slip over an upper surface of and be disposed under the left blocking portion in order to be slidable in the left retaining guideway. Since no positioning means is disposed in the slots to limit the movement of the pin members in the slots, the transverse axle of the second linking frame is liable to separate from the left retaining guideway when the transverse axles are moved away from one another. Therefore, the linking frames are liable to disengage from the base plate. In addition, the pin members are liable to escape from the slots via the guiding grooves, thus resulting in undesired separation of the first and second linking frames.

SUMMARY OF THE INVENTION

The object of the present invention is to provide a computer key having linking frames that can be retained positively on a base plate.

Another object of the present invention is to provide a computer key in which the linking frames can be retained positively to one another.

According to the present invention, a computer key comprises a one-piece base plate, a membrane circuit, a flexible sheet member, an upright elastomeric biasing member, a first linking frame, a second linking frame, and a push button. The base plate includes left and right slidably retaining guideways which are spaced apart from each other in a longitudinal direction of the base plate to define an actuation area therebetween. The left and right slidably retaining guideways are respectively formed by punching the base plate so as to have left and right retaining portions which respectively extend uprightly from an upper surface of the base plate, and left and right blocking portions which extend respectively from distal ends of the left and right retaining portions away from each other and substantially longitudinal to the base plate so as to block movement in an upward and normal direction relative to a plane of the upper surface of the base plate. The left and right blocking portions have left and right widths defined in a transverse direction relative to the longitudinal direction of the base plate by front and rear left edges and front and rear right edges, respectively. The membrane circuit is disposed on the upper surface of the base plate, and has a contact area superimposed upon the actuation area, and first left and right openings which are disposed to match positions of the left and right blocking portions so as to permit extension of the left and right blocking portions outwardly of the first left and right openings. The sheet member is superimposed on the membrane circuit, and defines an actuation transmitting area and an annular mounting area which surrounds the actuation transmitting area. The actuation transmitting area is of a dimension matching that of and is superimposed on the contact area of the membrane circuit. The sheet member further has second left and right openings aligned with the first left and right openings to permit extension of the left and right blocking portions outwardly through the second left and right openings.

The biasing member is disposed on the mounting seat area of the sheet member, and includes an upper depressing portion and a spacing lower portion to space the upper depressing portion from the mounting seat area. The upper depressing portion is movable against a biasing action thereof to depress the actuation transmitting area as well as the contact area of the membrane circuit to generate an electrical signal.

The first linking frame includes a first transverse axle and a pair of first linking arms. The first transverse axle is oriented in the transverse direction of the base plate, and has a first middle segment of a first length shorter than the right width and insertable slidably under the right blocking portion, and first front and rear segments which flank the first middle segment and which extend beyond the front and rear edges of the right blocking portion respectively in the transverse direction. Each of the first front and rear segments has a cut-out first upper surface such that, while the first middle segment slides under the right blocking portion, the first upper surface will not contact either of the front and rear edges of the right blocking portion. The first linking arms extend respectively and radially from the first front and rear segments, and have a pair of first hooking fingers which are disposed at distal ends thereof and which are parallel to the first transverse axle.

The second linking frame includes a second transverse axle and a pair of second linking arms. The second transverse axle is oriented in the transverse direction of the base plate, and has a second middle segment of a second length shorter than the left width and insertable slidably under the left blocking portion, and second front and rear segments which flank the second middle segment and which extend beyond the front and rear edges of the left blocking portion respectively in the transverse direction. Each of the second front and rear segments has a cut-out second upper surface such that, while the second middle segment slides under the left blocking portion, the second upper surface will not contact either of the front and rear edges of the left blocking portion. The second linking arms extend respectively and radially from the second front and rear segments, and have a pair of second hooking fingers which are disposed at distal ends thereof and which are parallel to the second transverse axle. The first and second linking arms are connected pivotally to each other at intermediate portions thereof when the first and second middle segments are inserted into and are retained slidably under the right and left blocking portions, respectively.

The push button is disposed to actuate the depressing portion of the biasing member, and has left and right hingeably retaining members disposed on an underside thereof and spaced apart so as to hingeably retain the first and second pairs of hooking fingers, respectively.

Each of the second linking arms includes a pin member extending outwardly and transversely from the intermediate portion thereof. Each of the first linking arms has an elongated slot formed longitudinally in the intermediate portion thereof for inserting the pin member of the respective one of the second linking arms therein such that the pin member is movable along the elongated slot. Each of the first linking arms further has an internal wall defining the elongated slot, and a protrusion projecting from the internal wall into the elongated slot to form left and right sections longitudinally of the elongated slot and a restricted section between the left and right sections. The protrusions prevent the pin members from moving back to the left sections from the right sections when the pin members are inserted initially into the left sections and are forced to pass through the restricted sections into the right sections to enable the first and second middle segments to be inserted and retained slidably under the right and left blocking portions, respectively.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
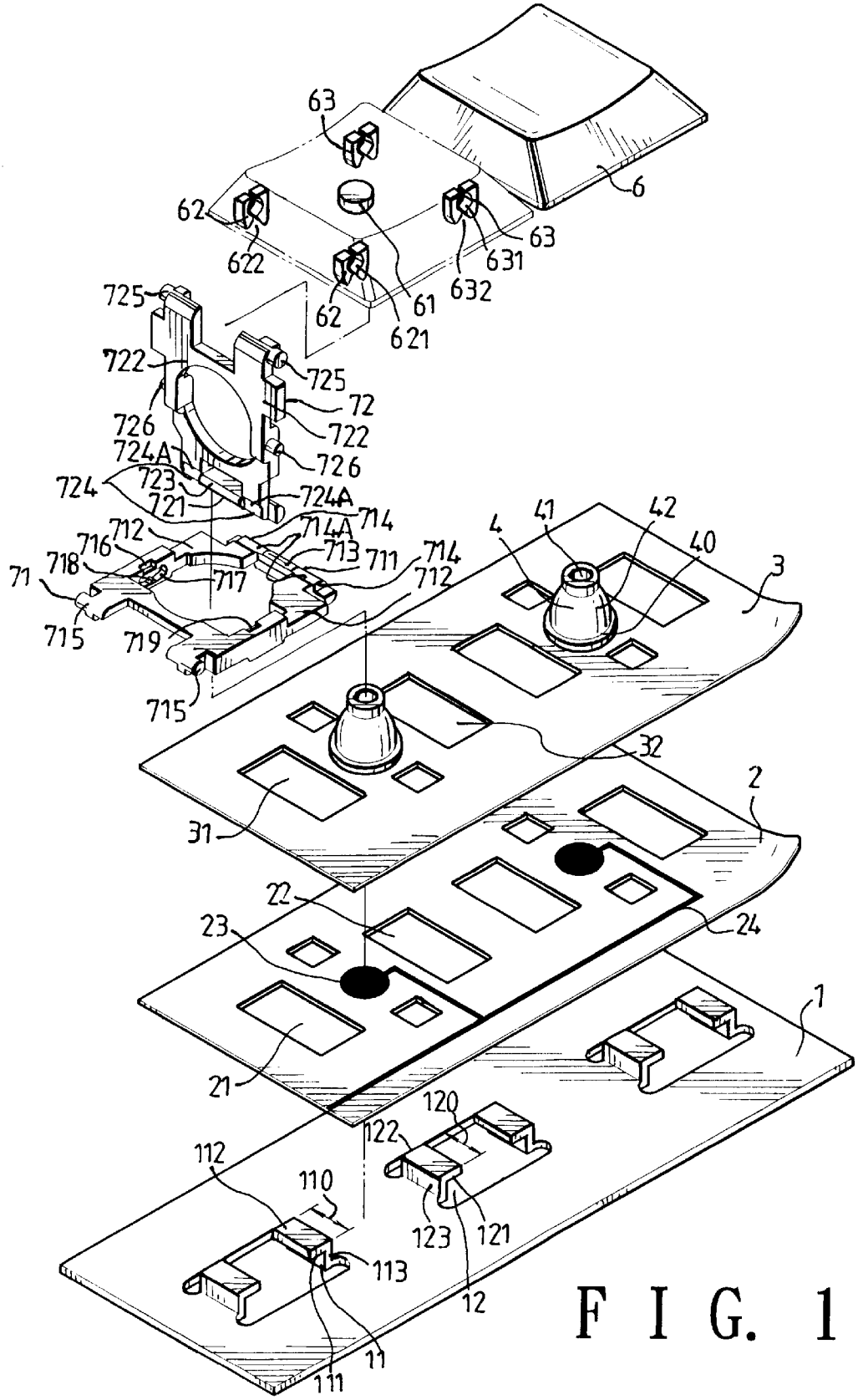
FIG. 1 is a perspective exploded view of a preferred embodiment of a computer key according to the present invention.

Referring to FIG. 1, the preferred embodiment of a computer key according to the present invention is shown to comprise a one-piece base plate 1, a membrane circuit 2, a flexible sheet member 3, an upright elastomeric biasing member 4, a push button 6, and a frame assembly 7.

As illustrated, the base plate 1 includes left and right slidably retaining guideways 11, 12 spaced apart from each other in a longitudinal direction of the base plate 1 to define an actuation area therebetween. The left and right slidably retaining guideways 11, 12 are respectively formed by punching the base plate 1 so as to have left and right retaining portions 113, 123 which extend uprightly from an upper surface of the base plate 1, and left and right blocking portions 112, 122 which extend from distal ends of the left and right retaining portions 113, 123 respectively away from each other in a direction substantially longitudinal to the base plate 1 so as to block movement in an upward and normal direction relative to a plane of the upper surface. The left and right blocking portions 112, 122 have left and right widths 110, 120 which are measured and defined in a transverse direction relative to the longitudinal direction of the base plate 1 by a first pair of front and rear left rough edges 111 and a second pair of front and rear right rough edges 121, respectively.

The membrane circuit 2 is disposed on the upper surface of the base plate 1, and has a contact area 23 of a dimension corresponding to and superimposed upon the actuation area, and first left and right openings 21, 22 which are disposed to match positions of the left and right blocking portions 112, 122 so as to permit extension of the latter through the first left and right openings 21, 22.

The sheet member 3, generally made of plastic, is superimposed on the membrane circuit 2, and defines an actuation transmitting area (not visible) and an annular mounting area (not visible) around the actuation transmitting area. The actuation transmitting area is of a dimension matching that of and is superimposed on the contact area 23 of the membrane circuit 2. The sheet member 3 has second left and right openings 31, 32 which are aligned with the first left and right openings 21, 22 to permit extension of the left and right blocking portions 112, 122 outwardly through the second left and right openings 31, 32.

The biasing member 4 is disposed on the mounting seat area of the sheet member 3, and includes an upper depressing portion 41 and a spacing lower portion 42 to space the upper depressing portion 41 from the mounting seat area. The spacing lower portion 42 of the biasing member 4 has an annular flange portion 40 that extends outwardly from a lower end thereof for mounting on the annular mounting area of the sheet member 3. The annular mounting area is preferably provided with an adhesive thereon so that the flange portion 40 can be mounted fixedly thereon. The upper depressing portion 41 of the biasing member 4 is movable against a biasing action thereof to depress the actuation transmitting area as well as the contact area 23 of the membrane circuit 2 to generate an electrical signal.

The frame assembly 7 consists of first and second linking frames 71, 72. The first linking frame 71 includes a first transverse axle 711 and a pair of first linking arms 712. The first transverse axle 711 is oriented in the transverse direction of the base plate 1, and has a first middle segment 713 of a length shorter than the right width 120 and insertable slidably under the right blocking portion 122, and front and rear segments 714 which flank the first middle segment 713 and which extend beyond the front and rear rough edges 121 of the right blocking portion 122, respectively. Each of the front and rear segments 714 has a cut-out first upper surface 714A such that, while the first middle segment 713 slides under the right blocking portion 122, the first upper surface 714A will not contact either of the front and rear rough edges 121 of the right blocking portion 122. The first linking arms 712 extend respectively and radially from the front and rear segments 714 of the first transverse axle 711, and have a pair of first hooking fingers 715 which are disposed at distal ends thereof and which are parallel to the first transverse axle 711.

The second linking frame 72 includes a second transverse axle 721 and a pair of second linking arms 722. The second transverse axle 721 is oriented in the transverse direction of the base plate 1, and has a second middle segment 723 of a length shorter than the left width 110 and is insertable slidably under the left blocking portion 112, and front and rear segments 724 which flank the second middle segment 723 and which extend beyond the front and rear rough edges 111 of the left blocking portion 112, respectively. Each of the front and rear segments 724 has a cut-out second upper surface 724A such that, while the second middle segment 723 slides under the left blocking portion 112, the second upper surface 724A will not contact either of the front and rear rough edges 111 of the left blocking portion 112. The second linking arms 722 extend respectively and radially from the front and rear segments 724, and have a pair of second hooking fingers 725 which are disposed at distal ends thereof and which are parallel to the second transverse axle 721.

The first and second linking arms 712, 722 are connected pivotally to each other at intermediate portions thereof such that the first and second linking arms 712, 722 cooperatively confine a space to accommodate movement of the biasing member 4 when the first and second middle segments 713, 723 are inserted into and are retained slidably under the right and left blocking portions 122, 112, respectively.

The push button 6 is disposed to actuate the depressing portion 41 of the biasing member 4, and has a central projection 61 on an underside thereof, and left and right hingeably retaining members 62, 63 disposed on the underside thereof and spaced apart so as to hingeably retain the first and second hooking fingers 715, 725 of the first and second frames 71, 72, respectively. Each of the left and right hingeably retaining members 62, 63 is formed with a pair of clamping pieces 621, 631, and an entrance 622, 632 between the lower ends of the clamping pieces 621, 631.

Figure 2:
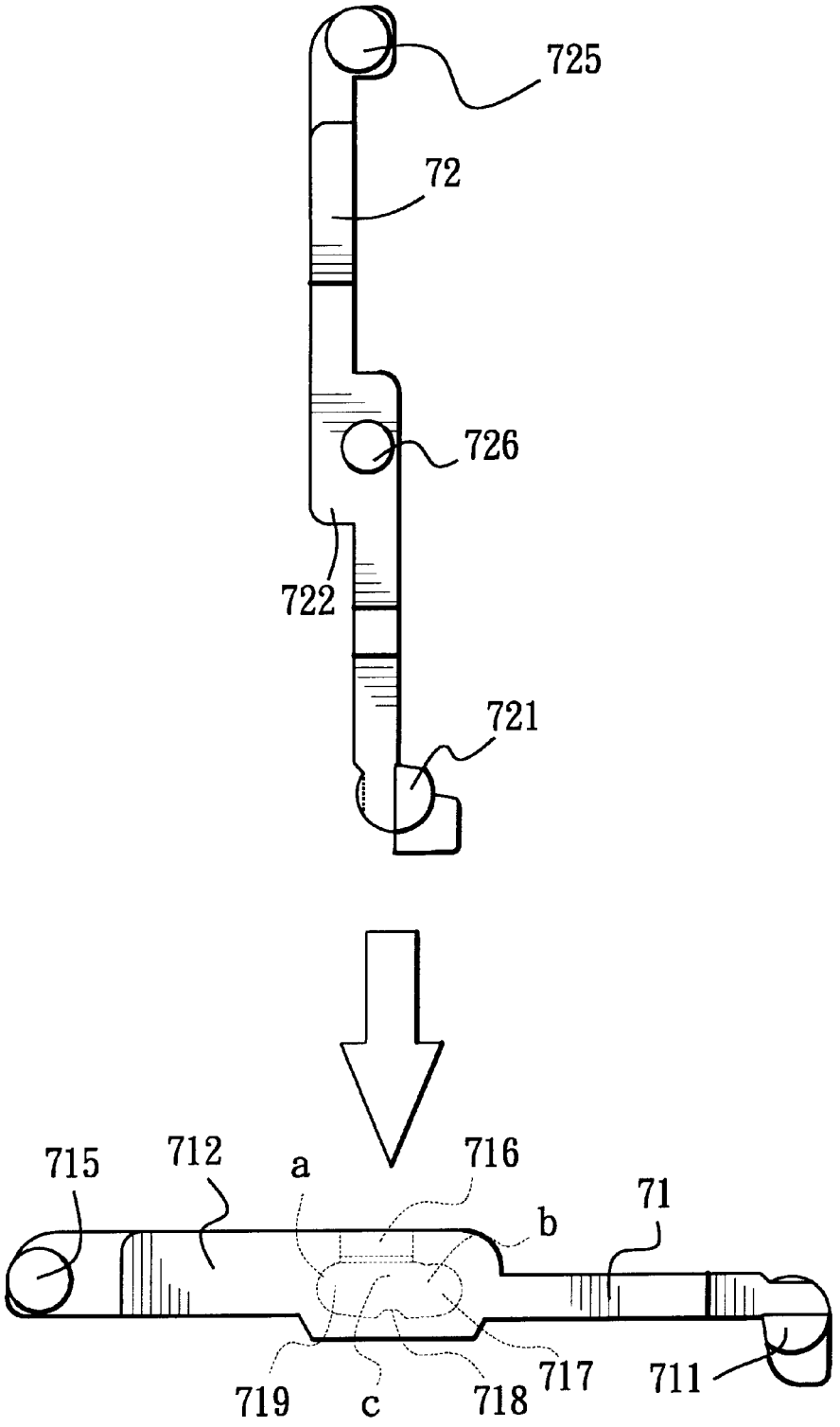
FIGS. 2 to 5 are schematic views illustrating how linking frames of the computer key of the preferred embodiment are connected to one another according to the present invention.

Each of the second linking arms 722 includes a pin member 726 extending outwardly and transversely from the intermediate portion thereof. Each of the first linking arms 712 has an elongated slot 717 longitudinally formed in the intermediate portion thereof for inserting the pin member 726 of the respective one of the second linking arms 722 therein such that the pin member 726 is movable along the elongated slot 717. The length of each of the pin members 726 is shorter than the depth of each of the elongated slots 717. In addition, the cross section of each of the pin members 726 is slightly smaller than of that of each of the slots 717. Each of the first linking arms 712 further has an internal wall 7171 defining the elongated slot 717, and a protrusion 718 projecting upwardly from the internal wall 7171 into the elongated slot 717 to form left and right sections (a, b) longitudinally of the elongated slot 717 and a restricted section (c) between the left and right sections (a, b), as best illustrated in FIG. 2. The protrusions 718 prevent the pin members 726 from moving back to the left sections (a) from the right sections (b) when the pin members 726 are inserted initially into the left sections (a) and are forced to pass through the restricted sections (c) into the right sections (b) to enable the first and second middle segments 713, 723 to be inserted and retained slidably under the right and left blocking portions 122, 112, respectively.

Referring to FIGS. 1 and 2, the intermediate portion of each of the first linking arms 712 has a guiding groove 716 disposed in an inner surface thereof proximate to the second linking arm 722 that is pivotally connected thereto. The guiding groove 716 extends downwardly from an upper surface in a direction transverse to the first linking arms 712 and has an inclined bottom face 719 adjacent to the internal wall 7171 of the respective one of the elongated slots 717 so as to guide insertion and slipping of the pin member 726 into the left section (a) of the respective one of the elongated slots 717 from above. The guiding groove 716 in each of the first linking arms 712 is elongated in a direction parallel to the elongated slot 717 thereof, and has a length shorter than that of the elongated slot 717, and a center point that is offset from the protrusion 718 in the elongated slot 717 in the direction transverse to the elongated slot 717. Each of the elongated slots 717 is of such a dimension that the first transverse axle 711 can be pulled to slip over an upper surface of and be disposed under the right blocking portion 122 in order to be slidable in the right retaining guideway 12, and can be subsequently pushed to shift the pin members 726 in the elongated slots 717 from the left sections (a) to the right sections (b) through the restricted sections (C), as best illustrated in FIGS. 7 and 8.

During assembly, the membrane circuit 2 and the sheet member 3 are mounted sequentially on the base plate 1 to permit the left blocking portion 112 and the left retaining portion 113 to extend through the first left opening 21 and the second left opening 31 and to permit the right blocking portion 122 and the right retaining portion 123 to extend through the first right opening 22 and the second right opening 32. As such, the left and right slidably retaining guideways 11, 12 can project from the sheet member 3.

Figure 3:
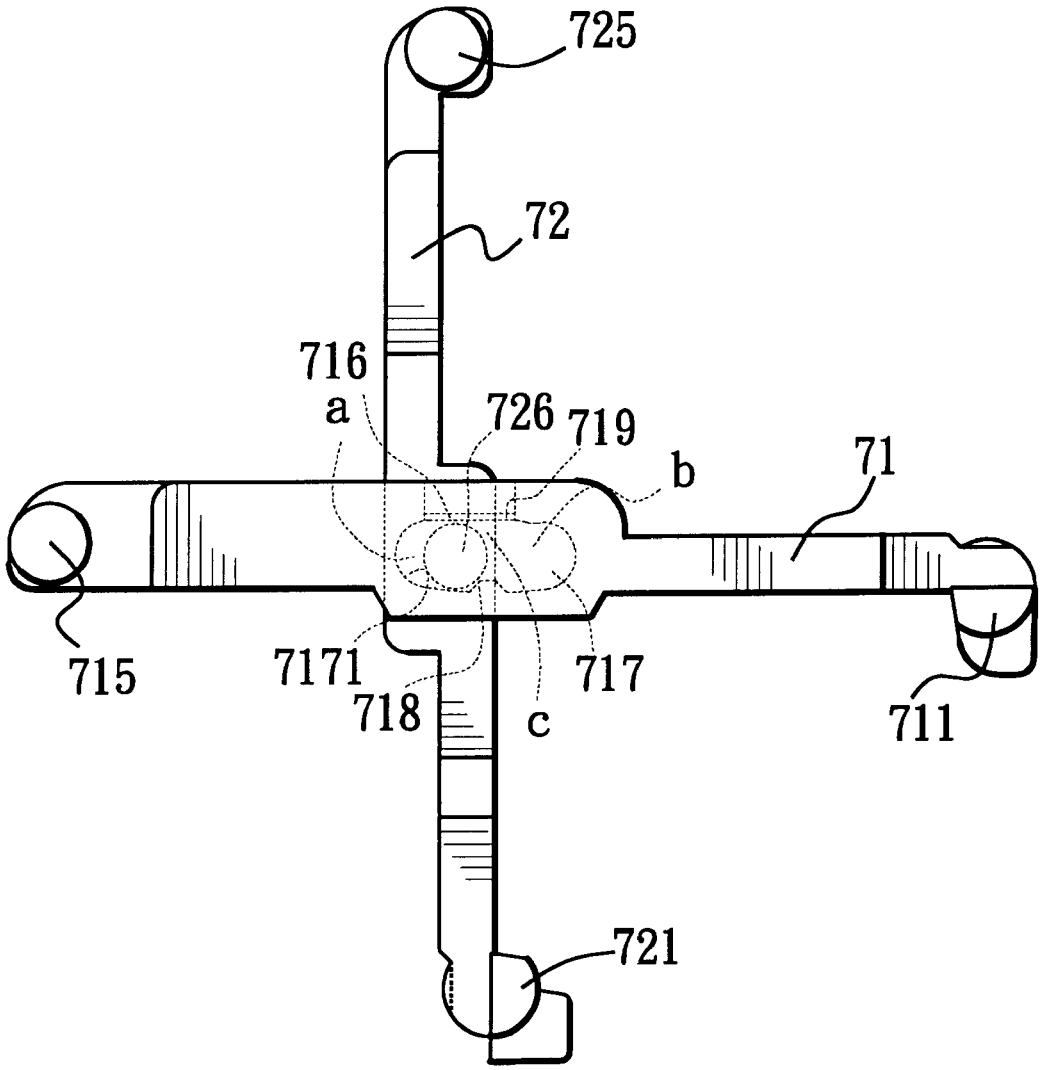
Figure 4:
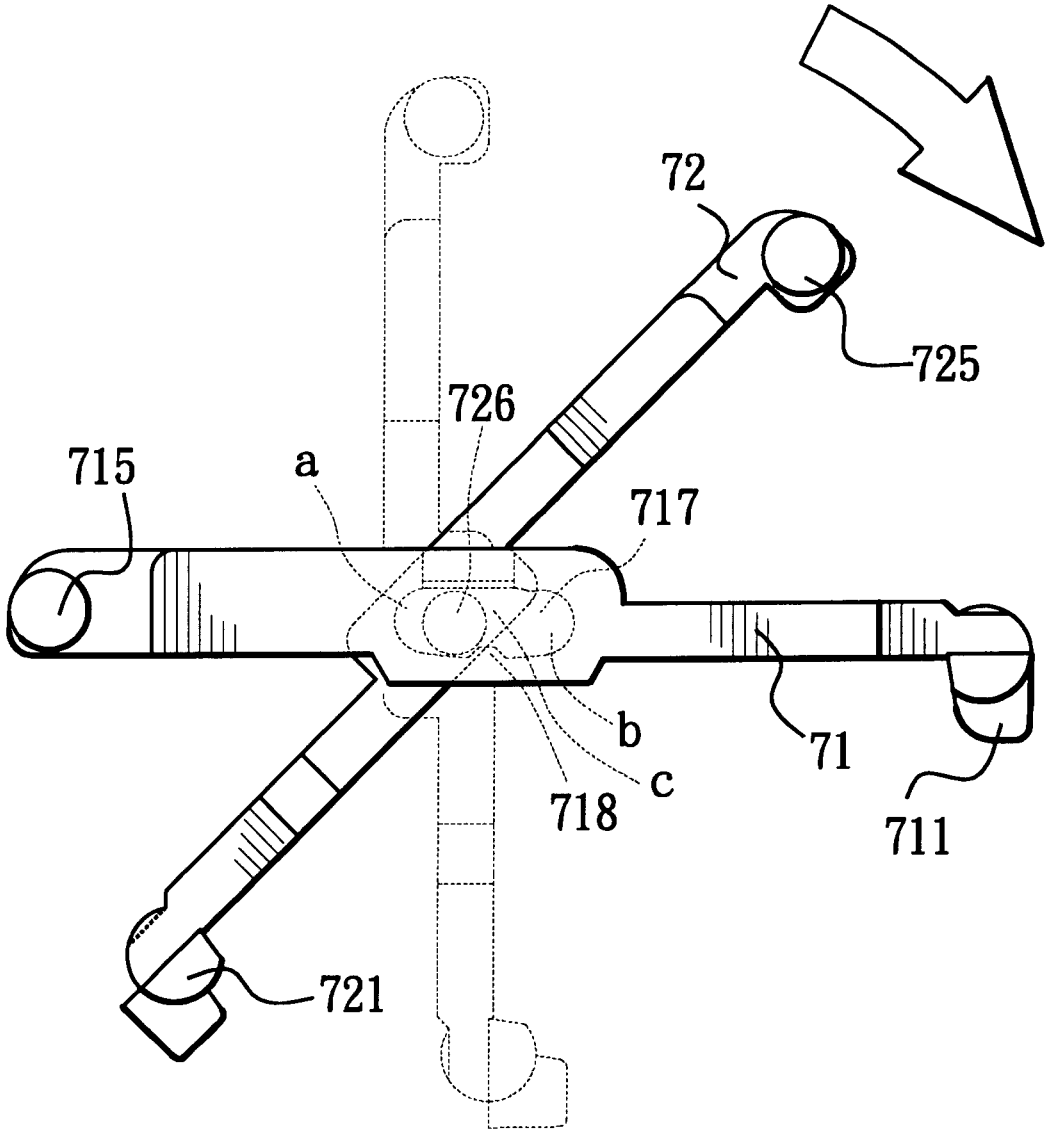
Figure 5:
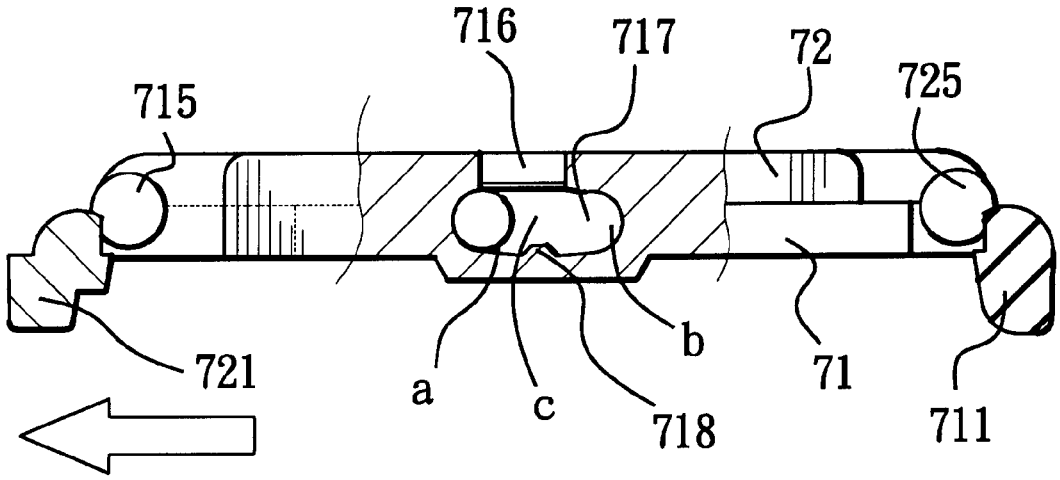

Referring to FIGS. 2 to 5, when it is desired to interconnect the first and second linking frames 71, 72, the second transverse axle 721 of the second linking frame 72 is moved downwardly to pass through a hollow portion of the first linking frame 71, as best illustrated in FIG. 2. Then, the pin members 726 are slid respectively into the left sections (a) via the guiding grooves 716 and the inclined bottom faces 719 of the guiding grooves 716, as best illustrated in FIG. 3. At this time, the first and second linking arms 71, 72 are orthogonal relative to one another, and the pin members 726 abut respectively against the protrusions 718. Next, the second linking frame 72 is rotated clockwise about the pin members 726 relative to the first linking frame 71 to enable the second hooking fingers 725 to move toward the first transverse axle 711 and to enable the second transverse axle 721 to move toward the first hooking fingers 715, as best illustrated in FIG. 4. When the second hooking fingers 725 are located above the first transverse axle 711, and the first hooking fingers 715 is located above the second transverse axle 721, the second transverse axle 721 is pulled away from the first transverse axle 711 to enable the pin members 726 to abut against the left ends of the left sections (a), as best illustrated in FIG. 5. At this time, the spacing between the second transverse axle 721 and the first transverse axle 711 is at a maximum value.

Figure 6:
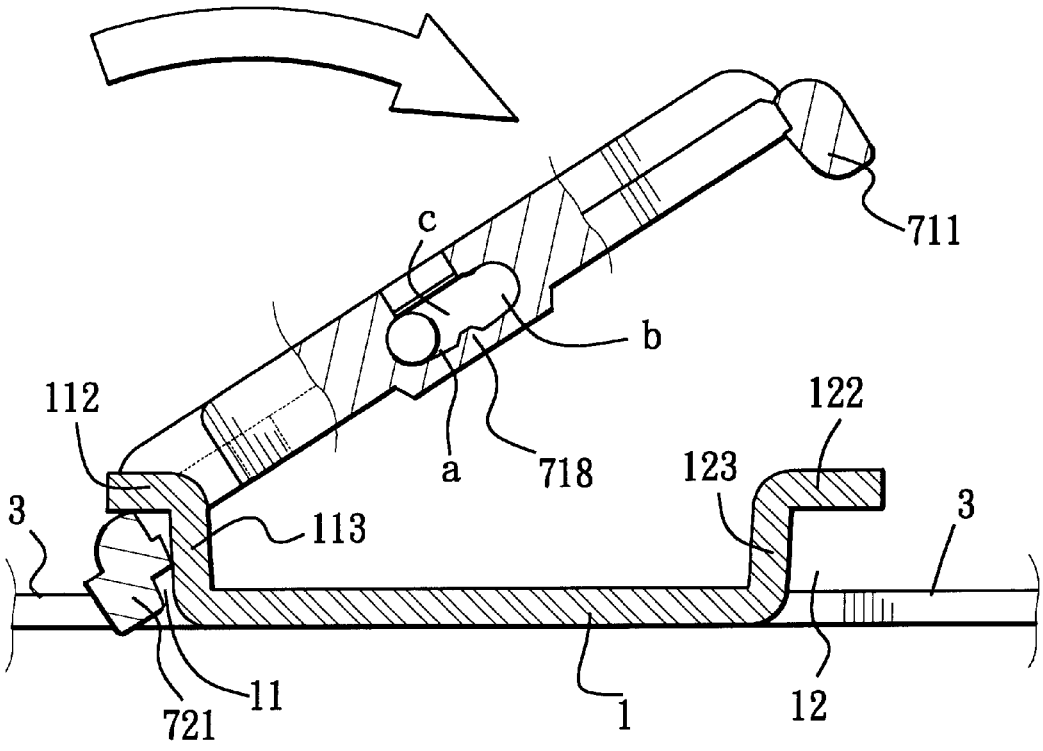
FIGS. 6 to 8 are schematic views illustrating how the linking frames are connected to the base plate of the preferred embodiment of the computer key according to the present invention.
Figure 7:
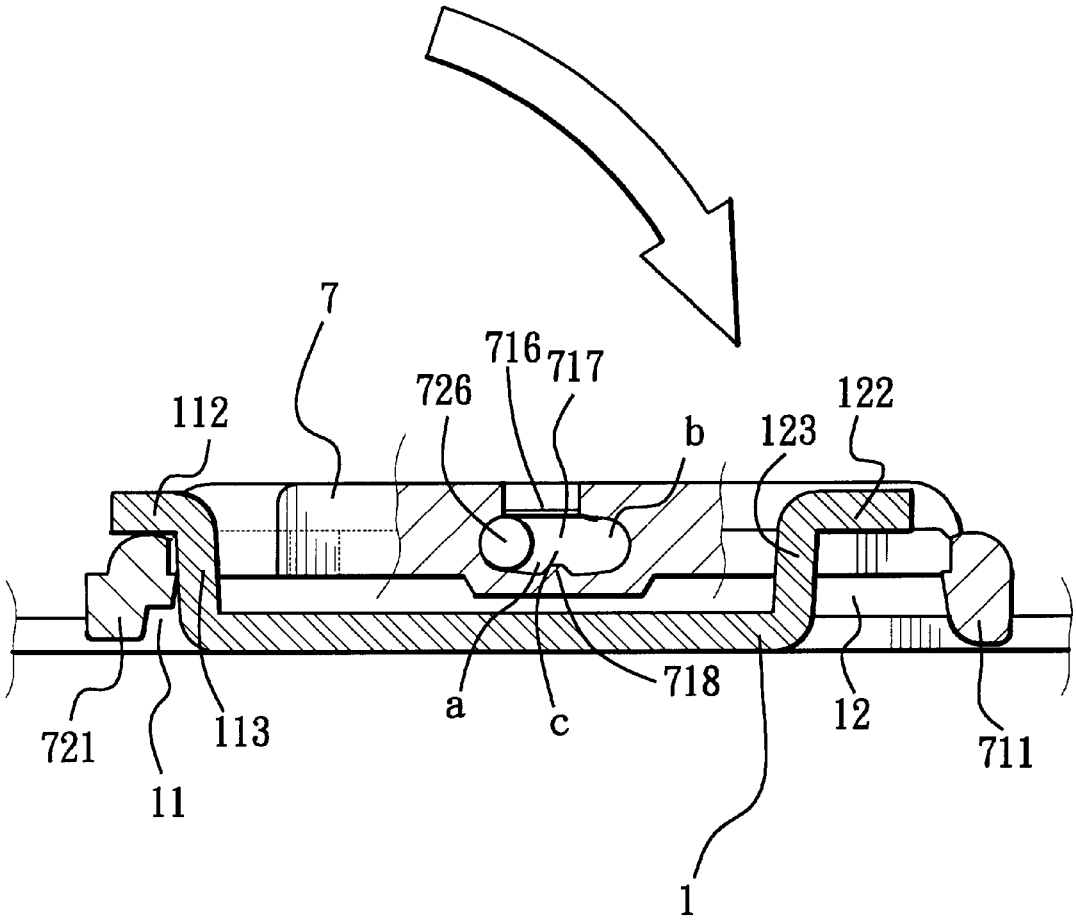
Figure 8:
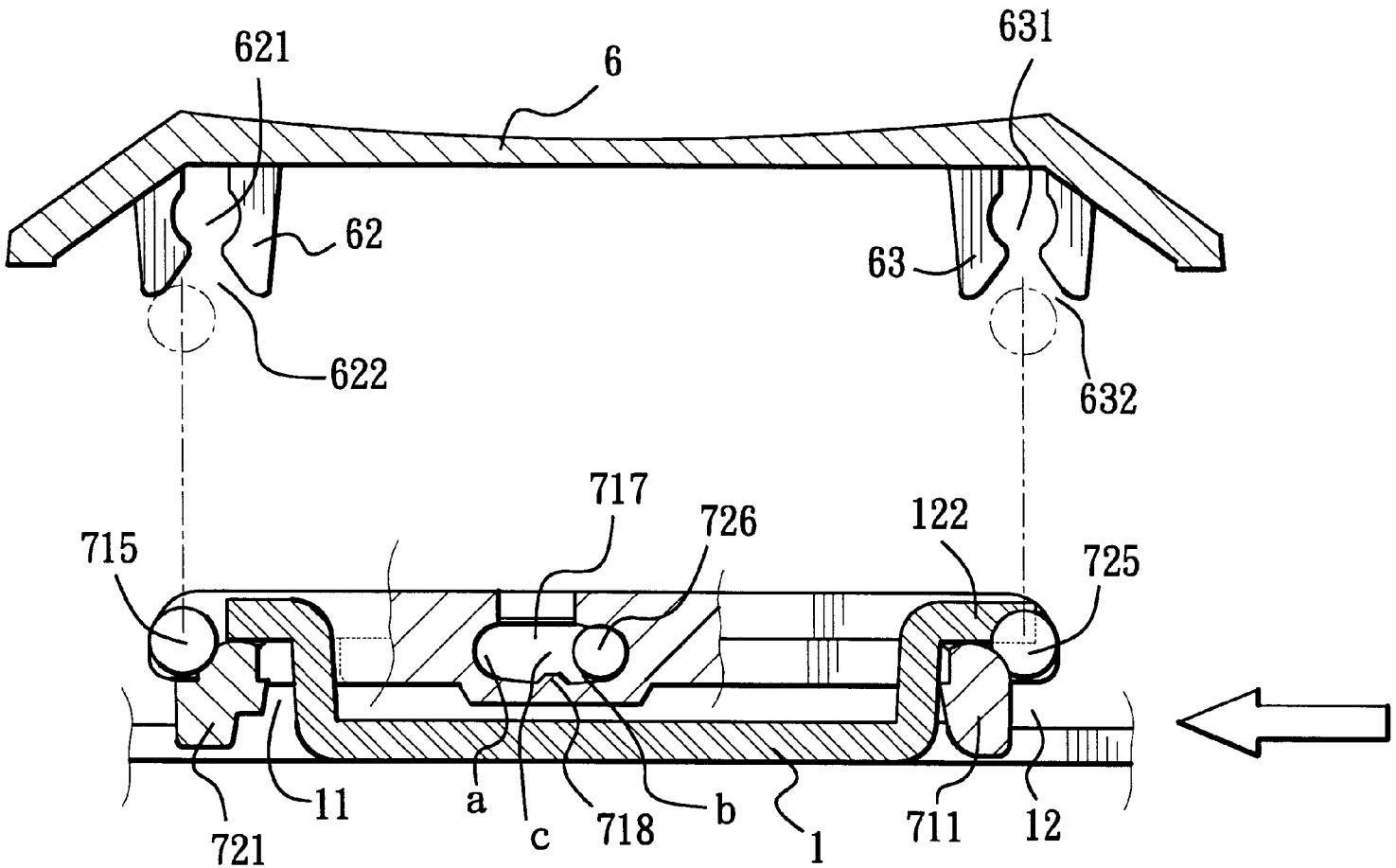

Referring to FIGS. 6 to 8, when it is desired to connect the first and second linking frames 71, 72 to the base plate 1, the second transverse axle 721 is inserted under the left blocking portion 112, as best illustrated in FIG. 6. The first transverse axle 711 is then pulled to slip over an upper surface of and be disposed under the right blocking portion 122 in order to be slidable in the right retaining guideway 12, and can be subsequently pushed to shift the pin members 726 in the elongated slots 717 from the left sections (a) to the right sections (b) through the restricted sections (C), as best illustrated in FIGS. 7 and 8. At this time, the first and second transverse axles 711, 721 are at a distance shorter than the maximum value and are prevented from being disengaged from the right and left retaining guideways 12, 11 because the pin members 726 are blocked from moving back to the left section (a). In addition, the pin members 726 can be prevented from slipping out of the elongated slots 717 via the guiding grooves 716 when the pin members 726 are retained in the right sections (b). In this way, the frame assembly 7 can be retained positively on the base plate 1.

Figure 9:
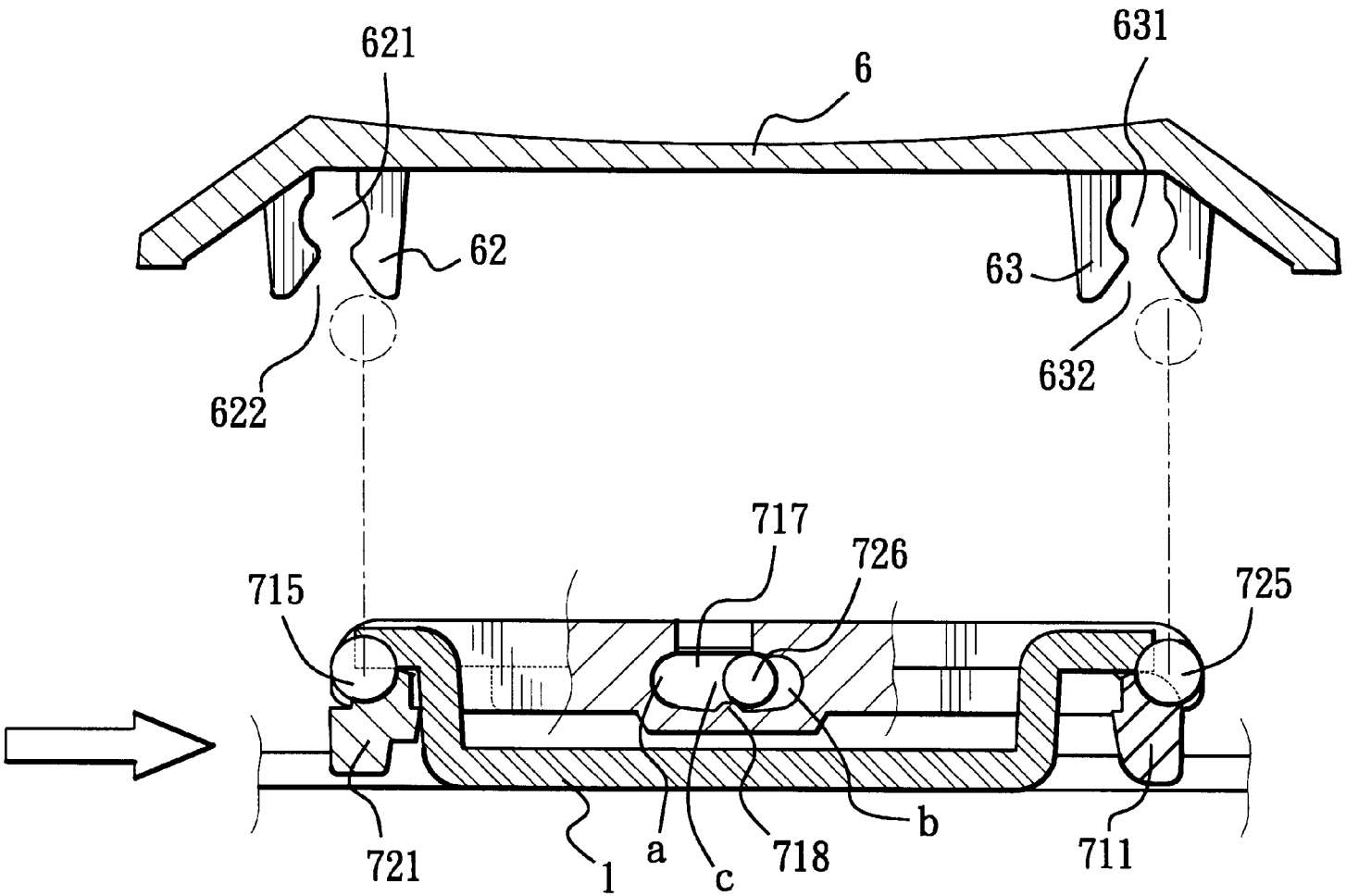
FIGS. 9 and 10 are schematic views illustrating how the linking frames are connected to the push button of the preferred embodiment of the computer key according to the present invention.
Figure 10:
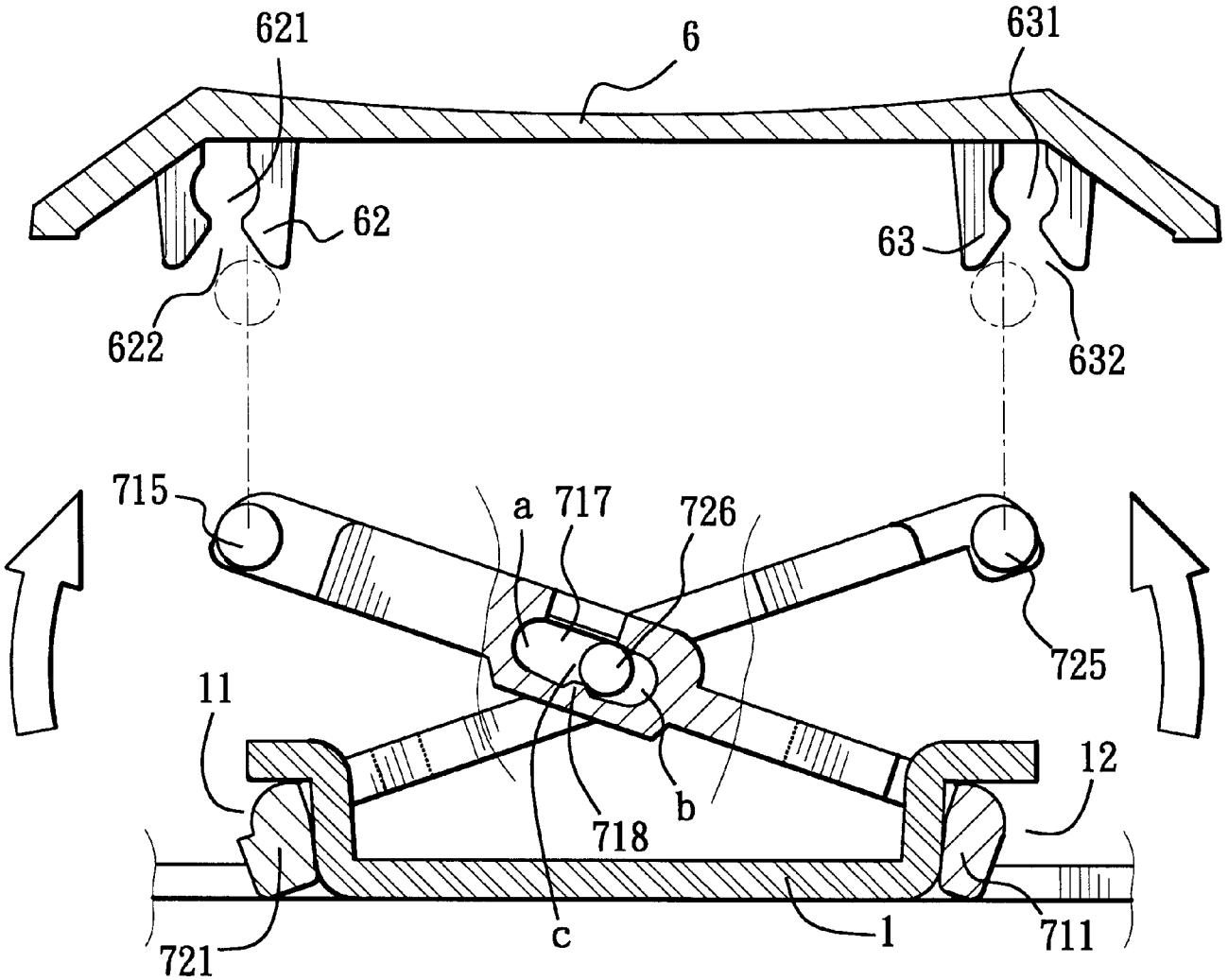

Note that since the first and second linking frames 71, 72 are connected pivotally to one another at the intermediate portions thereof, the distance between first hooking fingers 715 and the second hooking fingers 725 vary as the first and second transverse axles 711, 721 move relative to one another. The length of the right sections (b) is of a dimension such that the first and second hooking fingers 715, 725 can engage respectively the left and right hingeably retaining members 62, 63 when the pin members 726 are moved in the right sections (b) between a first position in which the pin members 726 abut against the protrusions 718, as best illustrated in FIGS. 9 and 10, and a second position in which the pin members 726 abut against the right ends of the right sections (b), as best illustrated in FIG. 8. That is to say, after the first and second transverse axles 711, 721 are retained in the right and left retaining guideways 12, 11, the first and second hooking fingers 715, 725 can engage easily the left and right hingeably retaining members 62, 63 regardless of how the first and second linking frames 71, 72 move relative to one another.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A computer key comprising:

a one-piece base plate including left and right slidably retaining guideways spaced apart from each other in a longitudinal direction of said base plate to define an actuation area therebetween, said left and right slidably retaining guideways being respectively formed by punching said base plate so as to have left and right retaining portions respectively extending uprightly from an upper surface of said base plate, and left and right blocking portions extending respectively from distal ends of said left and right retaining portions away from each other and substantially longitudinal to said base plate so as to block movement in an upward and normal direction relative to a plane of said upper surface, said left and right blocking portions having left and right widths defined in a transverse direction relative to said longitudinal direction of said base plate by front and rear left edges and front and rear right edges, respectively;

a membrane circuit disposed on said upper surface of said base plate, said membrane circuit having a contact area superimposed upon said actuation area, and first left and right openings disposed to match positions of said left and right blocking portions so as to permit extension of said left and right blocking portions outwardly of said first left and right openings;

a flexible sheet member superimposed on said membrane circuit, said sheet member defining an actuation transmitting area and an annular mounting area surrounding said actuation transmitting area, said actuation transmitting area being of a dimension matching that of and being superimposed on said contact area, said sheet member further having second left and right openings aligned with said first left and right openings to permit extension of said left and right blocking portions outwardly through said second left and right openings;

an upright elastomeric biasing member disposed on said mounting seat area of said sheet member, said biasing member including an upper depressing portion and a spacing lower portion to space said upper depressing portion from said mounting seat area, said upper depressing portion being movable against a biasing action thereof to depress said actuation transmitting area as well as said contact area of said membrane circuit to generate an electrical signal;

a first linking frame including:

a first transverse axle oriented in said transverse direction, said first transverse axle having a first middle segment of a first length shorter than said right width and being insertable slidably under said right blocking portion, and first front and rear segments flanking said first middle segment and extending beyond said front and rear edges of said right blocking portion respectively in said transverse direction, each of said first front and rear segments having a cut-out first upper surface such that, while said first middle segment slides under said right blocking portion, said first upper surface will not contact either of said front and rear edges of said right blocking portion; and a pair of first linking arms respectively and radially extending from said first front and rear segments, and having a pair of first hooking fingers disposed at distal ends thereof parallel to said first transverse axle; a second linking frame including:

a second transverse axle oriented in said transverse direction, said second transverse axle having a second middle segment of a second length shorter than said left width and being insertable slidably under said left blocking portion, and second front and rear segments flanking said second middle segment and extending beyond said front and rear edges of said left blocking portion respectively in said transverse direction, each of said second front and rear segments having a cut-out second upper surface such that, while said second middle segment slides under said left blocking portion, said second upper surface will not contact either of said front and rear edges of said left blocking portion; and a pair of second linking arms respectively and radially extending from said second front and rear segments, said second linking arms having a pair of second hooking fingers disposed at distal ends thereof parallel to said second transverse axle;

said first and second linking arms being connected pivotally to each other at intermediate portions thereof when said first and second middle segments are inserted into and are retained slidably under said right and left blocking portions, respectively; and a push button disposed to actuate said upper depressing portion of said biasing member and having left and right hingeably retaining members disposed on an underside thereof and spaced apart so as to hingeably retain said first and second pairs of hooking fingers, respectively;

each of said second linking arms including a pin member extending outwardly and transversely from said intermediate portion thereof, each of said first linking arms having an elongated slot formed longitudinally in said intermediate portion thereof for inserting said pin member of the respective one of said second linking arms therein such that said pin member is movable along said elongated slot, an internal wall defining said elongated slot, and a protrusion projecting from said internal wall into said elongated slot to form left and right sections longitudinally of said elongated slot and a restricted section between said left and right sections, said protrusion preventing said pin member from moving back to said left section from said right section when said pin member is inserted initially into said left section and is forced to pass through said restricted section into said right section to enable said first and second middle segments to be inserted and retained slidably under said right and left blocking portions, respectively.

2. The computer key as claimed in claim 1, wherein said intermediate portion of each of said first linking arms has a guiding groove disposed in an inner surface thereof proximate to said second linking arm that is pivotally connected thereto, said guiding groove extending downwardly from an upper surface in a direction transverse to said first linking arms and having an inclined bottom face adjacent to said internal wall of the respective one of said elongated slots so as to guide insertion and slipping of said pin member into said left section of the respective one of said elongated slots from above.

3. The computer key as claimed in claim 2, wherein said guiding groove in each of said first linking arms is elongated in a direction parallel to said elongated slot thereof, and has a length shorter than that of said elongated slot, and a center point that is offset from said protrusion in said elongated slot in the direction transverse to said elongated slot.

4. The computer key as claimed in claim 2, wherein said elongated slot is of such a dimension that, after said first and second linking arms have been pivotally connected to each other, and after said second transverse axle has been initially inserted under said left blocking portion, said first transverse axle can be pulled to slip over an upper surface of and be disposed under said right blocking portion in order to be slidable in said right retaining guideway, and said first transverse axle can be subsequently pushed to shift said pin members in said elongated slots from said left sections to said right sections through said restricted sections.

* * * * *